US006366679B1

(12) United States Patent
Steffen et al.

(10) Patent No.: US 6,366,679 B1
(45) **Date of Patent: *Apr. 2, 2002**

(54) MULTI-CHANNEL SOUND TRANSMISSION METHOD

(75) Inventors: Frank Steffen, Blankenfelde; Matthias Domke, Granschuetz, both of (DE)

(73) Assignee: Deutsche Telekom AG, Bonn (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/963,724

(22) Filed: Nov. 4, 1997

(30) Foreign Application Priority Data

Nov. 7, 1996 (DE) ..... 196 45 867

(51) Int. Cl.[7] ..... H04R 9/08; H04R 3/00; H04R 5/00

(52) U.S. Cl. ..... 381/356; 381/92; 381/26

(58) Field of Search ..... 381/26, 92, 356, 381/357, 358, 17, 18

(56) References Cited

U.S. PATENT DOCUMENTS

| | | | | |
|---|---|---|---|---|
| 4,393,270 A | * | 7/1983 | Van Den Berg | 381/356 |
| 4,856,064 A | | 8/1989 | Iwamatsu | |
| 5,023,913 A | | 6/1991 | Matsumoto et al. | |
| 5,260,920 A | | 11/1993 | Ide et al. | |
| 5,521,981 A | | 5/1996 | Gehring | |
| 5,666,425 A | * | 9/1997 | Sibbald et al. | 381/26 |

FOREIGN PATENT DOCUMENTS

| | | |
|---|---|---|
| DE | 26 16 665 | 5/1982 |
| JP | 3-136600 | 9/1991 |

OTHER PUBLICATIONS

Takemoto et al., "New Method for Sound Field Reproduction," IEEE Transactions on Consumer Electronics, vol. 35, No. 4, Nov. 1989, pp. 775–784.

R. Schneider, "Mehrkanal–Tonsysteme," Production Partner, issue 4/93, pp. 24–32.

R. Schneider, "Mehrkanal–Tonsysteme," Production Partner, issue 5/93, pp. 48–57.

Kleiner et al., "Auralization–An Overview," JAES, vol. 41, No. 11, (1993) pp. 861–875.

Frank Steffen, "Richtungsbezogene mehrkanalige Übertragung von Schallquellen mit Stützung durch getrennt aufgenommene Rauminformation [Direct multi–channel reproduction of sound sources with support of divided received room information]," Nov. 17, 1996 to the 19. Tonmeistertagung.

* cited by examiner

*Primary Examiner*—Forester W. Isen
*Assistant Examiner*—Laura A. Grier
(74) *Attorney, Agent, or Firm*—Kenyon & Kenyon

(57) ABSTRACT

A method wherein an auralization is performed, in that a plurality of spatial pulse responses are incited from various locations in the same room, and are received via a multichannel receiving apparatus, for example, a directional microphone or a plurality of directional microphones at one location, and are recorded. For the reproduction, a multichannel loudspeaker arrangement of vertically configured loudspeakers and of horizontally configured loudspeakers is used, at least two loudspeakers being required to reproduce sources in one line from point to point that are able to be localized, at least three loudspeakers for reproduction in one plane, and at least four loudspeakers in one room. A convolution processing takes place with a plurality of directly received sound signals, conforming at least in number to the spatial pulse responses, so that the convolved signals are locally distributed between the locations of the reproduction loudspeakers or at the boundaries of a binaural signal, when the sound is reproduced via headphones.

3 Claims, 3 Drawing Sheets

MULTI-CHANNEL SOUND TRANSMISSION METHOD

FIELD OF THE INVENTION

The present invention relates to a multi-channel sound transmission method and more particularly to a multi-channel sound transmission method with stabilization of phantom sound sources.

BACKGROUND INFORMATION

Conventional multi-channel sound transmission methods, such as the quadrophony method and the 3/2-or Dolby pro logic method, use various matrix codings with different directional resolutions to the front. For the most part, these methods provide for using a central loudspeaker, which, however, often has a disturbing effect with regard to an accompanying image. Also, when there is no central loudspeaker, a lack of center orientation can be detected, which has quite a disadvantageous effect. Moreover, the ambient background sound often seems detached from the zone that determines the direction to the front, and it is difficult to realize desired lateral or side sources. The phantom sound sources between the loudspeakers are relatively unstable due to the frequency response characteristic, signal coherence, and listener position. An overview of the multi-channel sound system theory is described, for example, in issues 4 and 5/93, pp. 24 to 32, or 47 to 48 by R. Schneider in Production Partner, which is herewith incorporated by reference herein.

In conventional, auralization methods, spatial pulse responses are obtained in real or computer-simulated rooms, which after being convolved with a dry sound signal, usually by way of binaural headphone reproduction, less often by way of a multi-channel loudspeaker reproduction, render possible an enveloping sound reproduction. A disadvantage of these methods is that the only reproduction possible is that of a point source that can be localized. Moreover, in another conventional method by means of four microphones, three having a bilateral or octogonal characteristic and one having an omnidirectional characteristic, a previously recorded space is realized using a matrix circuit. However, the resolution is relatively low. Auralization methods are described, for example, in the essay, "Auralization—An Overview" by Kleiner, M.; Dalenbäck, B.-I.; Svensson, P. in JAES, vol. 41, no. 11 (1993) pp. 861–875, which is hereby incorporated by reference herein.

In "New Method for Sound Reproduction," IEEE Transactions on Consumer Electronics, Vol. 35, No. 4, November 1989, the contents of which are hereby incorporated by reference herein, a single pulse sound is used to measure reflections. The reproduced sound field can then be calculated through convolution of two kinds of reflections. This method has the disadvantage that phantom sound sources cannot be stabilized and that different listening areas can be realized.

SUMMARY OF THE INVENTION

An object of the present invention is to improve upon the stability of the phantom sound sources and to prevent, to the greatest extent possible, the reproduced sound from coinciding with the most proximate loudspeaker.

Another object of the present invention is to create a multi-channel transmission method which will make it possible to prevent phantom sound sources from wandering in an unintended manner, and which will ensure that for listener locations, which are not situated exactly in the middle of the axis between two loudspeakers, the localization of the sound source will fall in the most proximate loudspeaker.

The method of the present invention and achievement thereof are characterized, in particular, that with the aid of a multi-channel spatial pulse reception, at least two excitation locations and at least two-times three closely proximate microphone locations are used for one or more variably oriented directional microphone(s) in a real or simulated room for receiving the spatial pulse responses, a convolution processing takes place with a plurality of directly received sound signals, conforming at least in number to the spatial pulse responses, in digital sound-processing processors (5) and, in fact, so that the convolved signals are locally distributed between, or in a borderline case, at the locations of the reproduction loudspeakers or at the boundaries of a binaural signal, when the sound is reproduced via headphones.

Other farther features or embodiments of the present invention include: (a) that to receive the spatial pulse responses in a simulated room, counting segments to this effect are used (see block 108 of FIG. 4); (b) for the spatial sound transmission, a directional microphone (1) or a plurality of directional microphones (1, 2) or counting segments for receiving the pulse-response measuring signals radiated from at least two excitation locations, e.g., loudspeakers, is swivelled around the center point of the pick-up location, and at least three reproduction loudspeakers (4 and 6) of the sound signals convolved by the digital sound-processing processors (5) are oriented in the opposite direction to the orientation of the microphones or of the counting segments to detect the spatial pulse response; (c) to move phantom sound sources within the area of the first reflections of the spatial pulse responses between two values determined by interpolation (see block 110 of FIG. 4), a continuous transition takes place; (d) for use for a large-picture video conference, a locally separated three-channel transmission via two loudspeakers arranged to the left and right of the video screen, three spatial pulse responses from three side-by-side source locations are detected, which are used for purposes of convolution processing with the three dry sound signals from the right, middle, and left speakers being reproduced on the video screen, and that when the convolved sound signals are reproduced, the convolved sound signals originating from the right sources are reproduced via the right loudspeakers; those originating from the left sources via the left loudspeaker, and those convolved sound signals originating from the middle sources are reproduced with equal intensity via the two loudspeakers; and (e) to obtain an identically sounding reproduction from all three identically sounding source groups in (d), the middle group radiated from the two loudspeakers is reproduced, for example, at a level diminished by three dB compared to the two lateral source groups.

The present method makes it possible, inter alia, for relatively large listening surface areas to be produced, which under known stereophonic methods had often made up just one narrow area. This is achieved by performing an auralization, where conditions are improved by prompting a plurality of spatial pulse responses from various locations in the same room, to be received via a multi-channel receiving apparatus, for example, a directional microphone, at one location, and to be recorded. A multi-channel loudspeaker arrangement is used for the reproduction. The stability of the phantom sound sources is also improved, in particular, and the reproduction is largely prevented from coinciding with the most proximate loudspeaker.

DETAILED DESCRIPTION

Figure 1:
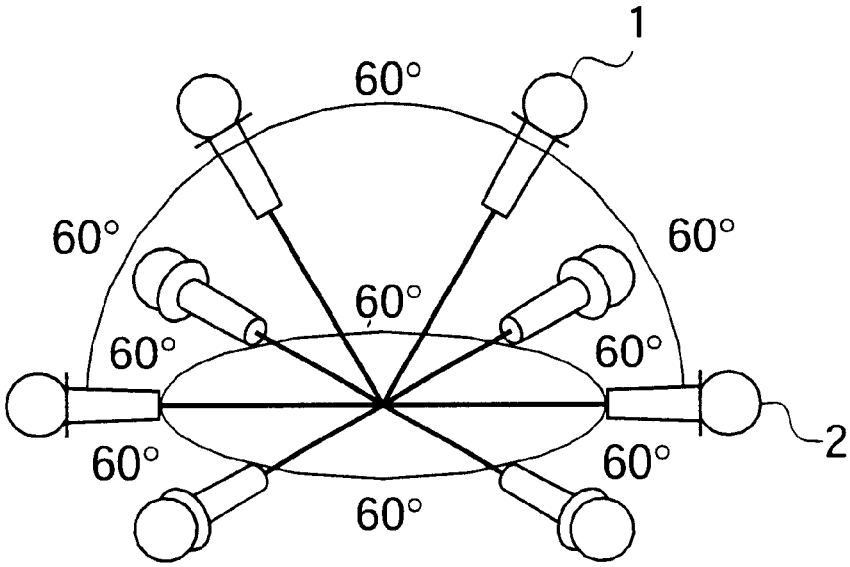
FIG. 1 illustrates a microphone arrangement according to the present invention including eight orientations for directional microphones.
Figure 4:
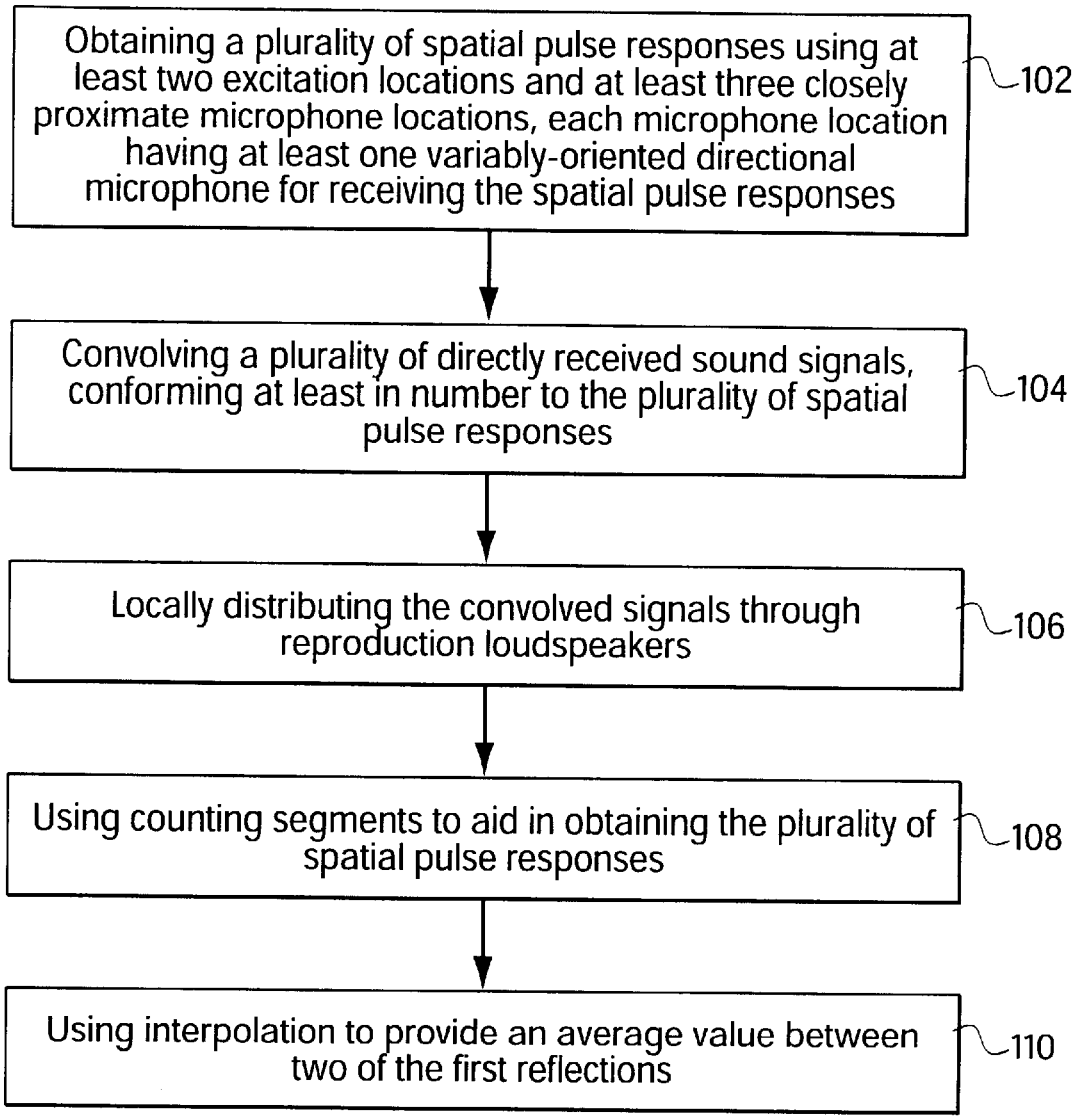
FIG. 4 shows aflow chart illustrating a method according to the present invention.

FIG. 1 illustrates a microphone arrangement used in a room, said microphone arrangement having eight different orientations for directional microphones 1 and 2 for receiving a split spatial pulse signal. Directional microphone 1 is shifted in succession, each time by 60° up to the orientation shown in FIG. 1. In the horizontal direction, six orientations of one directional microphone 2 are depicted, in each case for 60°. It should be mentioned here that both for the vertical directional microphones 1, as well as for the horizontal directional microphones 2, it is possible to configure individual microphones, e.g., each with 60° see block 102 of FIG. 4 displacement, as well as to configure a plurality of directional microphones, e.g., each at 60° see block 102 of FIG. 4.

The eight different orientations or positions of directional microphones 1 and 2 shown in FIG. 1 can be varied, as needed, depending on the requirements.

Figure 2A:
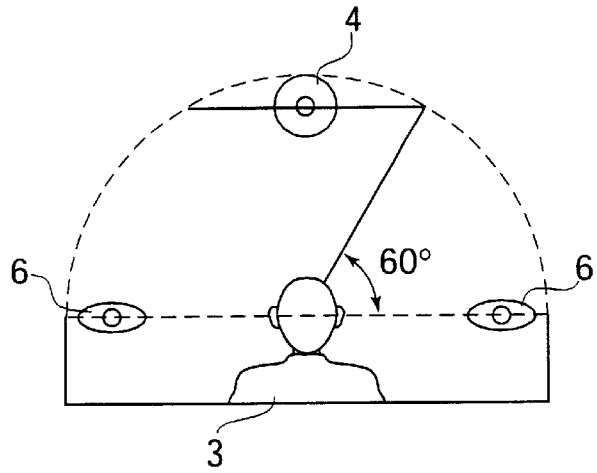
FIG. 2*a* illustrates a loudspeaker arrangement according to the present invention.
Figure 2B:
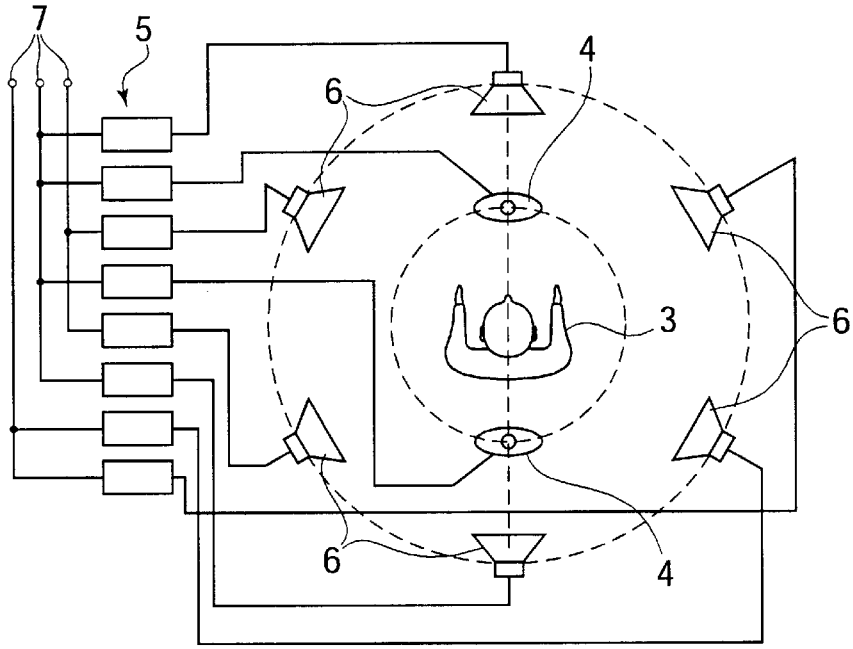
FIG. 2*b* illustrates a loudspeaker arrangement according to the present invention.
Figure 3:
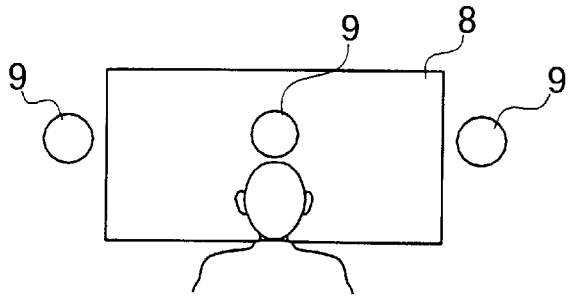
FIG. 3 illustrates a video screen and a loudspeaker arrangement according to the present invention.

FIGS. 2*a* and *b* show, first of all above, a listener 3 in the midpoint of a room. It is likewise possible to have several listeners in this area. Moreover, FIGS. 2*a* and 2*b* show the loudspeaker arrangement corresponding to the microphone arrangement of FIG. 1, with horizontally arranged loudspeakers 6 and vertically arranged loudspeakers 4. The partial signals are convolved in the digital sound-processing processors 5, said processors receiving their input signals via lines 7, which are divided up into right, left, and middle lines (see block 104 of FIG. 4). The output lines of the digital sound-processing processors 5 are then linked, accordingly, to loudspeakers 4 or 6 arranged in the room (see block 106 of FIG. 4). In this case, for example, the spatial pulse response picked up by microphone 2 undergoes convolution processing in one of the digital sound processing processors 5, and then is emitted via loudspeaker 6. At his or her location, listener 3 perceives the total signal emitted via loudspeaker 4, inclusive of the phantom sound sources forming during the emission. It consequently becomes clear that to improve the conditions, an auralization is performed, whereby a plurality of spatial pulse responses are excited from different locations of the same room, and are received via a multi-channel receiving apparatus, e.g., by one or more directional microphones, at one location, and are recorded. For the reproduction, a multi-channel loudspeaker arrangement including loudspeakers 4 and 6 in accordance with FIGS. 2*a* and 2*b* is used, which uses at least two loudspeakers to reproduce sources in one line that are able to be localized, at least three loudspeakers for reproduction in one plane, and at least four loudspeakers in one room. Through selection of the received spatial pulse responses, of the directly received sound signals used for convolution processing, and of the reproduction loudspeakers 4 or 6 by way of which the convolved signals are radiated, it is now possible to realize a one-, two-or three-dimensional sound reproduction, the gaps between the loudspeakers being filled in by phantom sound sources, which are stabilized by appropriately oriented spatial pulse responses. For purposes of stabilization, it is advantageous that at least one spatial pulse response be available from the direction from where the phantom sound source is supposed to be perceivable. One is limited in accommodating the phantom sound sources between two supporting loudspeakers for reasons having to do with the width of the directivity characteristics. For that reason, it is advantageous to use a larger number of reproduction loud speakers from areas from where a larger number of phantom sounds or reflections is to be expected. When working with a balanced reproduction from the spatial dimensions or a uniform diffusion distribution, a uniform distribution of the loudspeakers must also be undertaken.

If spatial information is also supposed to be effective from above, then one must also work with spatial pulse responses from above. When sources situated only around the listening location are to be reproduced, then one must use at least four, or even better, six reproduction loudspeakers 6 around the listening location or around listener(s) 3. If the intention is to only consider sources arranged in one line, then usually three reproduction loudspeakers situated in one line suffice, the middle one of these being replaceable, in some instances, by a phantom sound source. To render possible, for example, a locally separated three-channel transmission for a large-picture video conference via two loudspeakers 9 arranged to the left and right of the video screen 8, three spatial pulse responses from three side-by-side source locations are to be detected, which are used for purposes of convolution processing with the three dry sound signals from the right, middle, and left speakers being reproduced on the video screen. When the convolved sound signals are reproduced, the convolved sound signals originating from the right sources are reproduced via the right loudspeakers; in the same way, those originating from the left sources via the left loudspeaker; while those convolved sound signals originating from the middle sources are reproduced with equal intensity via the two loudspeakers. To obtain an identically sounding reproduction from all three identically sounding source groups, the middle group radiated from the two loudspeakers can be reproduced, being diminished by a level of three dB compared to the two lateral source groups. As already mentioned, however, other microphone arrangements and loudspeaker configurations to this effect are easily possible.

An example from a concert hall using a plurality of spatial pulse responses is as follows. Three different excitation points—loudspeakers—can be used, to be received by microphones in three different locations. For example, excitation point A is located on right side of the concert hall stage, excitation point B on the right and excitation point C in the middle of the stage. Loudspeakers are located at these points. At least one directional pick-up microphone is located in each of three different seating areas of the concert hall. Each directional microphone set (one set for each seating area location) can pick up the eight channels (forward right under, back right under, forward middle under, forward middle over, back middle over, back middle under, forward left under, back left under), shown in FIG. 1. A spatial pulse response is then received for excitation point A at each of the three seating locations and then for excitation point B and then for excitation point C. Seventy-two sets of data are obtained (three seating locations *8 microphone directions*three excitation points) which can then be used for further convolution processing, for example by a Lake Huron Digital Audio Convolution Workstation. A further description is in "Richtungsbezogene mehrkanalige Übertragung von Schallquellen mit Stützung durch getrennt aufgenommene Rauminformation [Directional multi-channel reproduction of sound sources with support of divided received room information]," paper delivered by Frank Steffen on Nov. 17, 1996 to the 19. Tonmeistertagung in Karlsruhe Germany, the entire contents of which are hereby incorporated by reference herein.

What is claimed is:

1. A multi-channel sound transmission method comprising the steps of:

obtaining a plurality of spatial pulse responses using at least three excitation locations and at least three closely proximate microphone locations, each microphone location having at least one variably-oriented directional microphone for receiving the spatial pulse responses;

convolving a plurality of directly received sound signals, conforming at least in number to the plurality of spatial pulse responses;

locally distributing the convolved signals through reproduction loudspeakers; and swivelling the at least one directional microphone around a center point so as to receive data from a plurality of receiving directions;

wherein there are at least two reproduction loudspeakers, each loudspeaker corresponding to one of the plurality of receiving directions and being oriented in a direction opposite to the corresponding receiving direction.

2. A multi-channel sound transmission method for use with a video screen and with left, right and middle loudspeakers, the method comprising the steps of:

obtaining a plurality of spatial pulse responses using at least tree excitation locations and at least three closely proximate microphone locations, each microphone location having at least one variably-oriented directional microphone for receiving the spatial pulse responses, wherein the at least three excitation locations comprise the left, right and middle loudspeakers arranged at a left side, a middle position and a right side of the video screen and the at least three microphone locations are side-by-side each other;

convolving a plurality of directly received sound signals, conforming at least in number to the plurality of spatial pulse responses; and locally distributing the convolved signals at least through the left and right loudspeakers; and reproducing three dry sound signals from the left, middle, and right loudspeakers at the video screen;

wherein when the convolved sound signals are reproduced, the convolved sound signals corresponding to a right direction are reproduced via the right loudspeaker, those corresponding to a left direction are reproduced via the left loudspeaker, and those convolved sound signals corresponding to a middle direction am reproduced with equal intensity via the left and the right loudspeakers.

3. The multi-channel sound transmission method as recited in claim 2 further comprising the step of diminishing the sound intensity of the convolved sound signal corresponding to the middle direction.

* * * * *